US006904731B2

(12) United States Patent
Wardle et al.

(10) Patent No.: US 6,904,731 B2
(45) Date of Patent: Jun. 14, 2005

(54) APPLICATION OF A MEMBRANE ROOF COVER SYSTEM HAVING A POLYESTER FOAM LAYER

(75) Inventors: Trevor Wardle, Ashland, KY (US); Michael J. Ennis, Reynoldsburg, OH (US)

(73) Assignee: Dow Global Technologies Inc., Midland, MI (US)

( * ) Notice: Subject to any disclaimer, the term of this patent is extended or adjusted under 35 U.S.C. 154(b) by 118 days.

(21) Appl. No.: 10/384,475

(22) Filed: Mar. 7, 2003

(65) Prior Publication Data

US 2003/0173014 A1 Sep. 18, 2003

Related U.S. Application Data

(60) Provisional application No. 60/364,631, filed on Mar. 14, 2002.

(51) Int. Cl.[7] ..... E04B 1/00

(52) U.S. Cl. ..... 52/746.11; 52/408; 52/409

(58) Field of Search ..... 52/746.11, 408, 52/309.8, 746.1, 743.3, 741.4, 409

(56) References Cited

U.S. PATENT DOCUMENTS

| | | | | |
|---|---|---|---|---|
| 3,029,172 A | * | 4/1962 | Glass | 428/316.6 |
| 3,345,246 A | * | 10/1967 | Sheahan | 442/326 |
| 4,073,997 A | * | 2/1978 | Richards et al. | 442/374 |
| 4,136,215 A | | 1/1979 | den Otter et al. | |
| 4,314,036 A | | 2/1982 | Throne et al. | |
| 4,418,108 A | | 11/1983 | Lin | |
| 4,503,106 A | | 3/1985 | Cogliano | |
| 4,843,103 A | | 6/1989 | Albertelli et al. | |
| 4,981,631 A | | 1/1991 | Cheung et al. | |
| 5,000,991 A | | 3/1991 | Hayashi et al. | |
| 5,229,432 A | | 7/1993 | Muschiatti | |
| 5,234,640 A | | 8/1993 | Amano et al. | |
| 5,288,764 A | | 2/1994 | Rotter et al. | |
| 5,340,846 A | | 8/1994 | Rotter et al. | |
| 5,362,763 A | | 11/1994 | Al Ghatta et al. | |
| 5,391,582 A | * | 2/1995 | Muschiatti et al. | 521/81 |
| 5,422,381 A | | 6/1995 | Al Ghatta et al. | |
| 5,446,111 A | | 8/1995 | Rotter et al. | |
| 5,475,037 A | | 12/1995 | Park et al. | |
| 5,536,793 A | | 7/1996 | Rootter et al. | |
| 5,556,926 A | | 9/1996 | Rootter et al. | |
| 5,679,295 A | | 10/1997 | Harfmann | |
| 5,681,865 A | | 10/1997 | Harfmann | |
| 5,696,176 A | | 12/1997 | Khemani et al. | |
| 5,784,845 A | * | 7/1998 | Imeokparia et al. | 52/408 |
| 5,958,164 A | | 9/1999 | Ishiwatari | |
| 5,985,190 A | | 11/1999 | Harfmann | |
| 6,063,316 A | | 5/2000 | Harfmann | |
| 6,067,770 A | | 5/2000 | Lubker, II et al. | |
| 6,418,687 B1 | * | 7/2002 | Cox | 52/309.4 |
| 6,427,404 B1 | * | 8/2002 | Hageman | 52/309.4 |
| 6,543,199 B1 | * | 4/2003 | Tomlinson et al. | 52/746.11 |

FOREIGN PATENT DOCUMENTS

| | | |
|---|---|---|
| CA | 2280070 | 2/2000 |
| EP | 307043 B1 | 1/1992 |
| FR | 2112619 | 11/1970 |
| FR | 2554151 | 10/1983 |
| GB | 2102809 | 7/1982 |
| JP | 53054347 | 5/1978 |
| WO | WO 02/099219 A1 | 12/2002 |

* cited by examiner

*Primary Examiner*—Laurie K. Cranmer
(74) *Attorney, Agent, or Firm*—Steven W. Mork

(57) ABSTRACT

Affix a membrane roof cover structure, comprising a polyester foam layer and a new membrane layer, over a roof deck structure such that the polyester foam layer is between the roof deck structure and the new membrane layer.

15 Claims, 1 Drawing Sheet

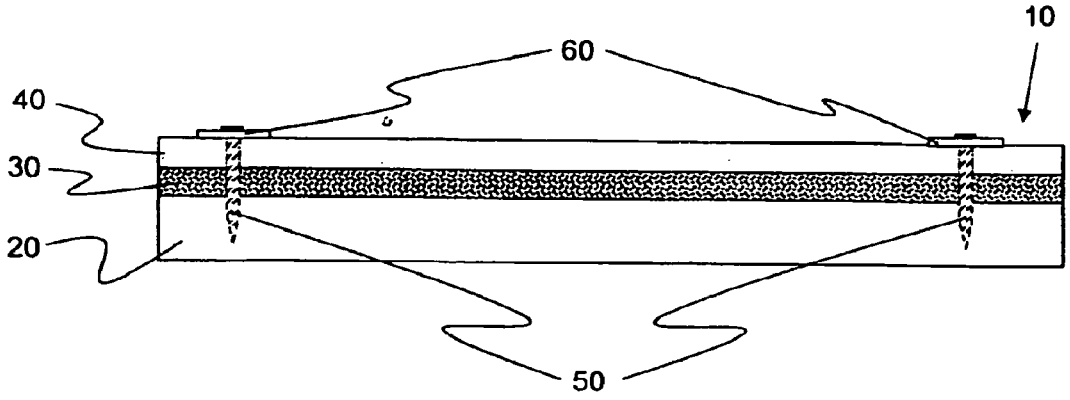
10
60
40
30
20
50

APPLICATION OF A MEMBRANE ROOF COVER SYSTEM HAVING A POLYESTER FOAM LAYER

CROSS REFERENCE STATEMENT

This application claims the benefit of U.S. Provisional Application No. 60/364,631, filed Mar. 14, 2002.

BACKGROUND OF THE INVENTION

1. Field of the Invention

The present invention relates to a process for applying a membrane roof cover system (MRCS) containing a polyester foam layer and a new membrane layer over roof deck structure.

2. Description of Related Art

MRCSs are useful for forming a watertight cover over low-sloped roofs. MRCSs can also include an insulation layer, which acts as a thermal insulator, acoustical insulator, or both. Common MRCSs include built-up roof systems (BURS) and flexible sheet membrane (FSM) systems.

BURS typically comprise an insulation layer that goes over a roof deck, a coverboard layer over the insulation layer, and a membrane over the coverboard. The membrane in a BURS generally comprises multiple layers of asphalt, asphalt impregnated fiberglass mat, modified bitumen, or a combination thereof. A FSM system typically comprises an insulation layer over a roof deck and a FSM over the insulation layer.

Membranes on MRCSs can develop cracks as they age, which can result in leaks in the MRCS. Repairing aged MRCSs can involve complete removal of an existing MRCS and application of a new MRCS. An alternative method of repair includes applying a recovery roof system (RRS) over an existing MRCS. RRSs typically include a coverboard to place over a membrane of the existing MRCS and a new membrane layer to go over the coverboard. The coverboard protects the new membrane from debris on the existing MRCS that can abrade and wear the new membrane, leading to a premature failure. Typical coverboards are 4 foot by 8 foot (1.2 meter by 2.4 meter) sheets of fiberboards that are 0.5 inches (1.27 centimeters (cm)) thick. The weight and size of these fiberboards makes their installation labor intensive. Moreover, fiberboards can absorb moisture, which can contribute to roof failures over time.

A process for applying a MRCS either in new roof construction or as a RRS, but that does not require a fiberboard, would be desirable. Of particular interest is such a process that involves simply rolling out a cover material and fastening the cover material to a roof deck.

BRIEF SUMMARY OF THE INVENTION

The present invention is a process comprising: (a) covering a roof deck structure with a polyester foam layer; (b) covering said polyester foam layer with a new membrane layer; and (c) affixing said foam layer and said new membrane layer to said roof deck structure; wherein said polyester foam layer contacts said roof deck structure and is between said roof deck structure and said new membrane layer.

DETAILED DESCRIPTION OF DRAWING

The drawing illustrates a general membrane roof cover system as applied to a roof deck in accordance with the process of present invention.

DETAILED DESCRIPTION OF THE INVENTION

"Roof deck structure" includes new roof decking as well as existing MRCSs that may exist over a roof deck. The process of the present invention is suitable for applying MRCSs over potentially abrasive roof deck structures since the polyester foam layer protects the new membrane layer from the roof deck structure. Examples of potentially abrasive roof deck structures include concrete, wood and debris that can exist on old MRCSs. The process of the present invention is particularly well suited for applying MRCSs as RRSs over an existing MRCSs. As a RRS, the polyester foam layer contacts a membrane of the existing MRCSs and protects the new membrane layer from debris on the existing MRCS.

MRCSs for use in the present invention have a polyester foam layer and a new membrane layer. The polyester foam layer protects the new membrane layer from abrasion caused by the roof deck structure, or debris on the roof deck structure. The polyester foam layer can also decrease the MRCS's thermal conductivity, acoustical transmittance, or both. Polyester foam is particularly well suited for roofing applications, as compared to other polymeric foams, due to its toughness, puncture resistance, thermal stability and solvent resistance. The MRCS can contain more layers, such as additional foam layers for added insulation or additional membrane layers, or adhesive layers. Typically, and MRCS for use in the present invention contains less than five layers. The MRCS desirably meets Class A, B, or C fire spread performance according to American Society for Testing and Material (ASTM) method E-108 fire test.

Polyester foam for use in the polyester foam layer can be board or sheet. Foam boards typically have a thickness of 10 millimeters (mm) or more. Conceptually, there is no upper limit as to how thick a foam board can be, however foam boards typically have a thickness of 100 mm or less, preferably 25.4 mm or less, more preferably 12.7 mm or less. Foam sheets typically have a thickness of at least 0.1 mm, preferably 0.75 mm, more preferably at least 2 mm and 6.5 mm or less, preferably 5 mm or less, more preferably 3 mm or less. Increasing a polyester foam's thickness improves the foam's ability to protect a new membrane from an existing roof structure as well as increases the thermal and acoustical insulating properties of the recovery system. However, Increasing a polyester foam's thickness also increases its weight and cost.

The polyester foam desirably has a density in a range of 0.05 grams per cubic centimeter (g/cc) to 0.2 g/cc, preferably 0.12 to 0.18 g/cc. Determine density according to ASTM method D-1622. Increasing a foam's density generally increases that foam's durability during handling and use. However, increasing a foam's density also tends to undesirably increase the foam's weight and thermal conductivity.

The polyester foam can be open- or close-celled. Close-celled foams are more desirable because they absorb less moisture and act as better thermal insulators than open-celled foams. Close-celled foams have an open cell content of less than 20% while open-celled foams have an open cell content of 20% or more. Determine open cell content according to American Society for Testing and Materials (ASTM) method D-2856.

Desirably, the polyester foam has sufficient flexibility to package in roll form. Normally, the polyester foam is a sheet in roll form that has a width in a range of one to 2.5 meters.

U.S. Pat. Nos. (USP) 6,063,316; 5,985,190; 5,958,164; 5,696,176; 5,681,865; 5,679,295; 5,556,926; 5,536,793;

5,475,037; 5,446,111; 5,422,381; 5,362,763; 5,340,846; 5,229,432; 5,288,764; 5,234,640; 5,000,991; and 4,981,631 (all of which are incorporated herein by reference) teach suitable methods for making polyester foam and foam sheet. Typically, prepare polyester foam using an extrusion process.

Suitable polyester foams include, for example, those comprising high-molecular weight polyesters that result from reacting an aromatic dicarboxylic acid with a dihydric alcohol. The aromatic dicarboxylic acid can be teraphthalic acid, diphenylsulfonedicarboxylic acid, diphenoxydicarboxylic acid and the like. The dihydric alcohol can be ethylene glycol, trimethylene glycol, tetramethylene glycol, neopentylene glycol, hexamethylene glycol, cylcohexanedimethylol, tricyclodecanedimethylol, 2,2-bis-(4-beta-hydroxyethoxyphenyl) propane, 4,4'-bis(beta-hydroxyethoxy)diphenylsulfone, diethylene glycol, as well as their respective esters. Desirably, a polyester foam for use in the present invention comprises polyethylene terphthalate (PET) or polybutylene terephthalate. Foams may comprise one or more than one polyester.

Polyester foams for use in the present invention preferably have some degree of crystallinity. Polyester foam sheet typically has a crystallinity of up to 30 percent (%), preferably in a range of 10 to 30%, more preferably in a range of 20 to 30%. Polyester foam board can have any degree of crystallinity, but desirably has at least 10%, preferably at least 20% crystallinity. Increasing a polyester foam's crystallinity increases the foam's thermal stability, while decreasing the foam's flexibility.

Crystallinity is a function of how much heating the foam experiences after extrusion. Generally, control a polyester foam's crystallinity using heating media such as heating rollers, hot air, or infrared radiation. Crystallinity varies by the type and temperature of the heating media and contact conditions of a foam with the heating media. Typically, crystallize a polyester foam at a temperature between 145 degrees Celsius (° C.) and 195° C. for a duration of two to six seconds. However, any foam that inhibits heat transfer will crystallize to some extent even without applying additional heat after extrusion.

Determine crystallinity of a polyester foam using the following equation, using differential scanning calorimetry (DSC) at a heating rate of 20° C. per minute to determine pertinent values:

$$\text{Crystallinity } (\%)=100(A-B)/C$$

Wherein:

A=heat of fusion/mol

B=heat of cold crystallization/mol; and

C=heat of fusion/mol of perfectly crystallized resin.

Determine a polyester foam's crystallinity prior to applying to an existing roof structure.

The new membrane layer comprises at least one new membrane. The new membrane can be, for example, asphalt or bitumen and can contain fibrous materials for reinforcement. Preferably, the new membrane is what is commonly known as a "flexible sheet membrane" (FSM). FSMs are thermoplastic or thermoset polymer sheets that are sufficiently flexible to package in roll form. FSMs typically have a thickness of 0.75 mm to 8 mm and can contain a reinforcing layer, typically fiberglass or polyester webbing, embedded within the polymer sheet.

Examples of suitable commercially available FSMs include GENFLEX™ RM-C (trademark of Omnova Solutions Inc.), EVERGUARD® (trademark of Building Materials Corporation of America), HYPALON®0 (trademark of E.I. DU PONT DE NEMOURS AND COMPANY), SURE-WELD® (trademark of Carlisle Management Company), SURE-SEAL® (trademark of Carlisle Management Company), VERSAGUARD™ (trademark of Soltech, Inc.), and RUBBERGARD™ (trademark of Bridgestone/Firestone Inc.) roofing systems.

The present invention involves placing a polyester foam layer over a roof deck structure, covering the polyester foam layer with a new membrane layer, and fastening the new membrane layer and polyester foam layer to the roof deck structure. Position the polyester foam layer between the roof deck structure and the new membrane layer.

In a first embodiment, apply the polyester foam layer and the new membrane layer separately. First lay a polyester foam layer over a roof deck structure and then lay a new membrane layer over the polyester foam layer. If the foam layer comprises more than one foam sheet, adjacent foam sheets desirably partially overla so that the sheets have a lower chance of separating thereby exposing the membrane layer to the roof deck structure or debris on the roof deck structure. Desirably, the foam is a sheet in roll form that allows unrolling of the foam sheet onto an existing roof structure.

Apply the new membrane layer over the polyester foam layer. If the new membrane layer is an asphalt or bitumen membrane, apply the asphalt or bitumen directly to the polyester foam layer. If the new membrane layer is a FSM layer, dispose a FSM onto the polyester foam layer. FSMs typically come in roll-form, allowing an installer to roll the FSM onto the polyester foam layer.

When using more than one FSM to form a new membrane layer, overlap adjacent FSMs by at least 50 mm, preferably at least 100 mm, and generally less than 500 mm. Seal the partially overlapping membranes to one another to form a watertight new membrane layer. Seal thermoplastic polymer FSMs together using an adhesive, by melt-welding, or by solvent-welding. Melt-weld membranes together by heating at least a portion of the overlapping section of one or both membranes sufficiently to plasticize the membrane(s), then bring the overlapping sections of the membranes together under pressure as the membrane(s) cool. A skilled artisan can readily determine how hot to heat a specific membrane and how long to apply pressure in order to effectively melt-weld two membranes together. Solvent-weld membranes together in a similar manner except apply a plasticizer (e.g., a solvent) to one or both membranes to plasticize them instead of heat. Hold the plasticized membranes together as the plasticizer evaporates until the membranes become sealed together. Seal thermoset polymer FSMs together using an adhesive.

A skilled artisan knows what adhesives are suitable for sealing FSMs. Typically, a FSM manufacturer recommends a particular adhesive for their particular FSM in order to maintain a warranty on the FSM. One example of a line of adhesives includes PLIOBOND™ (trademark of Ashland, Inc.).

The MRCS can further include an adhesive layer or coating between the polyester foam layer and the existing roof, between the new membrane layer and the polyester foam layer, both, or neither. Adhesives for use as adhesive layers between a new membrane and a polyester foam are include those described above for sealing a FSM. Typically the adhesive is available from the FSM manufacturer. Adhesives for use as adhesive layers between a polyester foam layer and an existing roof include polymeric adhesive films, such as ethylene vinyl acetate and adhesive materials such as PLIODECK™ (trademark of Ashland, Inc.), INSUL-BOND™ (trademark of Henry Company) and INSTA-STIK™ (trademark of Insta-Foam Products, Inc.) adhesives. An adhesive layer or coating is useful to affix the layers to the existing roof structure. Apply an adhesive layer or coating to the existing roof structure, polyester foam layer, new membrane layer, or any combination thereof during or prior to installation of the MRCS system.

In a desirable embodiment, affix the polyester foam layer and new membrane layers to the roof deck structure using mechanical fasteners. When using mechanical fasteners, the membrane layer and polyester foam layer can be affixed to one another with an adhesive or be essentially free from one another. Herein, a membrane layer affixed to a polyester foam layer only by means of a mechanical fastener is "essentially free" from the polyester foam layer. Examples of suitable mechanical fasteners include screws, bolts, nails, and staples. Preferably, the fastener is an Underwriter's Laboratory or Factory Mutual approved screw/plate. Install a fastener by driving it through the polyester foam layer, or both the polyester foam layer and new membrane layer, into the existing roof structure. Preferably, drive the fastener first through a force-distribution means. Force-distribution means, such as washers, metal plates, and plastic plates, distribute the fastener's holding force over a larger area of the polyester foam, new membrane, or both than does just the fastener. A common force-distribution means for use with roof recovery systems is a three-inch (76.2-mm) diameter plate. If a mechanical fastener does not penetrate through the new membrane layer, the new membrane layer must adhere to the polyester foam layer using another means, such as an adhesive. Preferably, a mechanical fastener penetrates through both the new membrane layer and polyester foam layer.

Seal the fasteners after their installation to prevent water from penetrating the MRCS where the fastener penetrated the MRCS. In a typical installation, position fasteners along an edge of a first membrane so that a second, adjacent membrane can overlap the edge of the first membrane sufficiently to cover the fasteners. Seal the second membrane to the first membrane by, for example, gluing, taping or melt-welding them together. Sealing the membranes together seals the fasteners covered by the second membrane. On roof edges, seal fasteners using counter flashing.

A second embodiment of the present invention involves covering a roof deck structure with a composite MRCS comprising a laminate of a polyester foam and a new membrane and then attaching the composite MRCS to the roof deck structure. A skilled artisan can identify numerous ways of attaching a new membrane to a polyester foam to form a composite MRCS. For example, laminate a FSM to a polyester foam using an adhesive or adhesive layer similar to those already described. Desirably, composite MRCSs comprise a polyester foam sheet bound to a FSM.

Such a composite MRCS allows simultaneous application of a polyester foam and new membrane onto roof deck structure. Desirably, the laminated composite is sufficiently flexible so as to be in roll form with application to an existing roof structure involving unrolling the laminated composite over the existing roof structure. Alternatively, place individual laminated composite sheets or boards onto the existing roof structure. As in the first embodiment, the polyester foam is in contact with the roof deck structure and sets the new membrane apart from the roof deck structure.

When using multiple laminated composites to cover an existing roof structure it is desirable to partially overlap the polyester foam, new membrane, or both polyester foam and new membrane of one composite MRCS with an adjacent composite MRCS. For example, a new membrane from one composite MRCS can extend off from an edge of a polyester foam of the same composite MRCS and partially overlap a new membrane from an adjacent composite MRCS. Overlapping the membranes and then sealing them to one another forms a watertight seal between the two composite MRCSs. In a second example, the new membrane on each of two adjacent composite MRCS extends beyond and are not attached to the edges of polyester foam of their respective composite MRCSs for a distance at least equal to the distance the membrane extends beyond the edge of the polyester foam. Upon application of the composite MRCS onto an existing roof structure tuck the membrane of a first composite MRCS between the membrane and polyester foam of a second, adjacent composite MRCS and then overlay and seal the new membrane from the second composite MRCS over the membrane of the first composite MRCS. The polyester foam of each of these two composite MRCS can also overlap under the new membranes. These are only examples of many ways to apply composite MRCS to an existing roof structure.

Affix the composite MRCS(s) to an existing roof structure in a manner similar to that of the first embodiment. For example, in the second example of the second embodiment an artisan can affix the polyester foam layer and new membrane layer to an existing roof structure by driving mechanical fasteners through the edge of the polyester foam of each laminated composite under the new membrane prior to tucking and sealing the new membranes. The new membranes then seal the mechanical fasteners as well as the interface between laminated composites.

Seal the new membrane layer around the roof deck structure's perimeter in accordance with the National Roofing Contractor's Association (NRCA) roofing and waterproofing guide, and preferably in accordance with directions from the manufacture of the new membrane. Suitable methods of sealing the new membrane layer's perimeter depend on the type of roof deck structure but can include sealing the new membrane to a counter flashing, to a metal edge trim, or running the new membrane over an existing wall structure and sealing the membrane to the wall structure. Skilled artisans are familiar with various methods of sealing a membrane to a roof edge.

These are but a few of many different embodiments and examples of the present invention and serve to describe the basic process of the present invention rather than all possible variations within its scope.

The following examples further illustrate the present invention without limiting its scope.

EXAMPLE

EX 1

Roll out PET foam sheet (2.5 mm thick, 1.2 meter (m) wide, 0.2 g/cc density, 20% crystalline) onto an existing low slope roof over an old membrane. Roll out sufficient rows of PET foam sheet so as to cover the existing roof, overlapping adjacent foam sheets by 100 mm. Apply a new fleeced-back thermoplastic polyolefin (TPO) membrane (e.g., EP-Fleece from Steven Roofing, Inc.) onto the PET foam sheet by rolling out sufficient rows of the new roof membrane to cover the PET foam layer. Overlap adjacent rows of new membrane by 100 mm, staggering the joints of new membrane with respect to joints of foam sheet. Drive fasteners (Olympic Fastener STD #12 (C-Steel)—a screw type fastener with a 3-inch (7.62 cm) diameter plate for a force distribution means) through the new membrane and foam along the edge of each new membrane sheet under where an adjoining membrane sheet overlaps. The spacing of the fasteners is sufficient to achieve compliance with local building codes regarding roofing wind resistance. Seal adjacent new membrane sheets together by melt-welding them using an industrial hot air gun at 300° C. Seal edges of the membrane around the perimeter of the roof using a combination of mechanical fasteners and adhesives in conjunction with flashing and counterflashing materials in accordance with The National Roofing Constrictors Association and/or the roofing membrane manufacturer rules and guidelines.

Ex 1 illustrates a method of applying a MRCS as a recovery roof system over an existing roof containing an old membrane wherein the new membrane is essentially free from the polyester foam.

EX 2

Form laminated composites by adhering PET foam sheet (same as in Ex 1) to new fleeced-back TPO membranes (same as in Ex 1) using INSTA-STIK or SPRAY 'N GRIP™ adhesives (ARPAY'N GRIP is a trademark of Flexible Products Company; INSTA-STIK and SPRAY 'N GRIP are available from The Dow Chemical Company). The PET foam sheet and TPO membrane have the same dimensions but are offset from one another exposing a 100 mm wide strip of PET foam sheet along one edge of the laminated composite and allowing a 100 mm wide strip of TPO membrane to extend off from the opposing edge of the PET foam sheet.

Affix the laminated composites to an existing roof construction containing an old membrane. Place the laminated composites so that the polyester foam of each composite contacts the old membrane and the TPO membrane of each composite is remote from the old membrane. Drive fasteners through the exposed 100-mm wide strip of PET foam on each laminated composite. The spacing of the fasteners is sufficient to achieve compliance with local building codes regarding roofing wind resistance. Seal a new TPO membrane over the fasteners and 100 mm wide strip of exposed PET foam using TPO membrane from an adjacent laminated composite. Seal the TPO membrane to the PET foam using PLIOBOND 9752 adhesive. Seal edges of the membrane around the perimeter of the roof using a combination of mechanical fasteners and adhesives in conjunction with flashing and counter-flashing materials in accordance with The National Roofing Constrictors Association and/or the roofing membrane manufacturer rules and guidelines.

Ex 2 illustrates a method of applying a recovery roof system over an existing roof containing an old membrane wherein the new membrane and polyester foam are in the form of a laminated composite.

The process of Ex 1 or Ex 2 will work equally as well on a new roof deck structure such as a wooden deck.

The drawing illustrates a portion of a general membrane roof cover system 10 comprising polyester foam 30 and new membrane layer 40 on roof deck 20 and affixed to the roof deck using fasteners 50 and force distribution means 60. In the context of Ex 1 and Ex 2, PET foam sheet 30 and a new fleeced-back TPO membrane 40 are on top of roof deck 20. Roof deck 20 can be the existing roof of Ex 1 and Ex 2. Fasteners 50 and force distribution means 60 hold TPO membrane 40 and foam sheet 30 to roof deck 20.

What is claimed is:

1. A process comprising: (a) covering a roof deck structure with a polyester foam that is in a form of board or sheet; (b) covering said polyester foam with a new membrane layer such that the polyester foam and new membrane contact one another, optionally by means of an adhesive; and (c) affixing said polyester foam and said new membrane layer to said roof deck structure; wherein said polyester foam contacts said roof deck structure and is between said roof deck structure and said new membrane layer.

2. The process of claim 1, wherein said roof deck structure comprises a membrane and said polyester foam layer contacts said membrane.

3. The process of claim 1, wherein said polyester foam comprises polyethylene terephthalate.

4. The process of claim 1, wherein said polyester foam layer has a thickness in a range of 0.75 millimeters to 6.5 millimeters.

5. The process of claim 1, wherein said polyester foam is close-celled.

6. The process of claim 1, wherein said polyester foam has a density in a range of 0.05 to 0.15 grams per cubic centimeter, according to ASTM method D-1622.

7. The process of claim 1, wherein said polyester foam has a crystallinity of 30 percent or less.

8. The process of claim 1, wherein step (a) comprises partially overlapping two or more polyester foam sheets to form said polyester foam layer.

9. The process of claim 1, wherein step (a) comprises unrolling said polyester foam onto said existing roof structure.

10. The process of claim 1, wherein said new membrane is a flexible sheet membrane.

11. The process of claim 1, wherein step (b) comprises partially overlapping two new membranes and sealing them together to form said new membrane layer.

12. The process of claim 1, wherein said membrane layer is essentially free from said polyester foam layer.

13. The process of claim 1, wherein steps (a) and (b) occur simultaneously by applying at least one composite membrane roof cover system to a roof deck structure.

14. The process of claim 13, further comprising unrolling said composite membrane roof cover system onto a roof deck structure.

15. The process of claim 1, wherein affixing said recovery roof system to said existing roof structure comprises driving mechanical fasteners through the new membrane layer and polyester foam layer into said roof deck structure.

* * * * *